US010306982B2

(12) United States Patent
Chiang et al.

(10) Patent No.: US 10,306,982 B2
(45) Date of Patent: Jun. 4, 2019

(54) BASKET DRAWER STRUCTURE

(71) Applicant: Shen Hao Metal Working Co., Ltd., Yilan, Yilan County (TW)

(72) Inventors: A-Ming Chiang, Yilan (TW); Wei-Ching Chiang, Yilan (TW)

(73) Assignee: Shen Hao Metal Working Co., Ltd., Yilan (TW)

( * ) Notice: Subject to any disclaimer, the term of this patent is extended or adjusted under 35 U.S.C. 154(b) by 0 days.

(21) Appl. No.: 15/949,239

(22) Filed: Apr. 10, 2018

(65) Prior Publication Data

US 2018/0338616 A1 Nov. 29, 2018

(30) Foreign Application Priority Data

May 24, 2017 (TW) ..... 106207477 U

(51) Int. Cl.
*A47F 3/06* (2006.01)
*A47B 88/40* (2017.01)
(Continued)

(52) U.S. Cl.
CPC ..... *A47B 88/427* (2017.01); *A47B 88/407* (2017.01); *A47B 88/437* (2017.01);
(Continued)

(58) Field of Classification Search
CPC ... A47B 88/427; A47B 88/407; A47B 88/437; A47B 2088/4274; A47B 2088/401; A47B 2088/0448; A47B 2031/002; A47B 2031/003; A47B 96/025; A47B 96/067; A47B 61/02; A47B 55/02; A47B 2210/0037; A47B 2210/0062; A47B 2210/0024; A47B 2210/0021; A47F 5/01; A47F 5/13; A47F 5/14; A47F 7/148; A47F 3/06; A47F 3/063; A47F 3/147; A47F 5/0093; A47L 15/50; A47L 15/507; A47L 15/501
(Continued)

(56) References Cited

U.S. PATENT DOCUMENTS 1,748,843 A * 2/1930 Kuckel ..... F25D 25/024 211/151
2,080,885 A * 5/1937 Cocks ..... F25D 3/06 220/DIG. 8
(Continued)

*Primary Examiner* — Jennifer E. Novosad
(74) *Attorney, Agent, or Firm* — Alan D. Kamrath; Mayer & Williams PC

(57) ABSTRACT

A basket drawer structure contains: a basket and two rail elements. The basket includes a mesh, a holding space, an opening, and a peripheral rib. The peripheral rib has two recessed portions, two orifices, and two first rollers. The two recessed portions have two shaft holes, and two rivets insert through the two shaft holes to rivet with the two first rollers individually. The two rail elements are symmetrically fixed on a shelf or a cabinet. A distance between the two rail elements is equal to a width of the basket, and the two rail elements respectively include two support rails. Two second rollers are riveted on two front ends of the two support rails individually. The basket is retained in the two support rails by way of the peripheral rib, and the two second rollers of the two rail elements are mounted in the peripheral rib.

2 Claims, 7 Drawing Sheets

(51) Int. Cl.
*A47L 15/50* (2006.01)
*A47B 88/407* (2017.01)
*A47B 88/427* (2017.01)
*A47B 88/437* (2017.01)

(52) U.S. Cl.
CPC ..... *A47F 3/063* (2013.01); *A47L 15/501* (2013.01); *A47L 15/507* (2013.01); *A47B 2088/401* (2017.01); *A47B 2088/4274* (2017.01); *A47B 2210/0021* (2013.01); *A47B 2210/0024* (2013.01); *A47B 2210/0062* (2013.01)

(58) Field of Classification Search
USPC ..... 211/88.01, 126.15, 126.9, 133.5, 133.2, 211/41.4, 151, 153, 181.1, 94.02; 108/30; 312/334.12, 334.1, 334.18, 312/334.21, 330.1
See application file for complete search history.

(56) References Cited

U.S. PATENT DOCUMENTS 2,103,885 A * 12/1937 Whalen ..... F25D 25/021 211/134
3,269,548 A * 8/1966 Geiger ..... A47L 15/50 134/165
3,556,625 A * 1/1971 Kauffman ..... A47L 15/507 312/301
4,199,200 A * 4/1980 Livingston ..... A47B 88/407 312/334.18
4,447,095 A * 5/1984 Fielding ..... A47B 88/487 312/334.18
4,595,247 A * 6/1986 Zank ..... A47B 88/487 312/334.19
4,913,298 A * 4/1990 Compagnucci ..... A47B 77/16 211/162
4,995,682 A * 2/1991 Gutner ..... G11B 23/0236 206/387.15
5,083,848 A * 1/1992 Merino ..... A47B 77/10 312/334.42
5,086,936 A * 2/1992 Remmers ..... A47B 67/04 211/126.15
5,209,555 A * 5/1993 Camilleri ..... A47B 88/402 312/311
5,330,063 A * 7/1994 Remmers ..... A47B 88/402 211/126.15
5,474,378 A * 12/1995 Smith ..... A47L 15/504 248/297.31
5,505,534 A * 4/1996 Laenn ..... A47B 88/40 312/330.1
5,810,179 A * 9/1998 Kleiman ..... A47B 61/00 211/106
5,980,009 A * 11/1999 Atalla ..... F25D 25/022 312/301
6,039,422 A * 3/2000 Butters ..... A47B 45/00 16/422
6,148,813 A * 11/2000 Barnes ..... F24C 15/168 108/143
6,336,564 B1 * 1/2002 Garnier ..... A47F 5/0068 211/162
6,491,173 B1 * 12/2002 Costa ..... A47B 88/427 211/126.15
6,578,720 B1 * 6/2003 Wang ..... A47F 5/0093 211/126.15
D493,308 S * 7/2004 Nilsson ..... D3/306
7,108,143 B1 * 9/2006 Lin ..... A47B 88/40 211/126.15
7,168,578 B2 * 1/2007 Mersch ..... A47L 15/504 134/56 D
D546,101 S * 7/2007 Knight ..... D6/705.6
7,406,833 B2 * 8/2008 Ertz ..... F25D 23/021 62/115
D628,388 S * 12/2010 Klein ..... D3/318
7,857,329 B2 * 12/2010 Cai ..... A47B 31/00 211/134
8,157,339 B2 * 4/2012 Park ..... A47B 88/483 312/331
9,186,038 B2 * 11/2015 Bastuji ..... A47L 15/502
9,468,293 B2 * 10/2016 Yang ..... A47B 96/00
9,861,200 B2 * 1/2018 Lim ..... A47B 96/07
2002/0125802 A1 * 9/2002 Remmers ..... A47B 88/402 312/334.7
2005/0001522 A1 * 1/2005 Yang ..... A47B 88/00 312/330.1
2006/0152118 A1 * 7/2006 Lee ..... F25D 25/022 312/404
2006/0219271 A1 * 10/2006 Feddema ..... A47L 15/502 134/56 D
2007/0235401 A1 * 10/2007 Costa ..... A47F 3/147 211/126.15
2008/0054772 A1 * 3/2008 Koloff ..... F25D 25/024 312/404
2009/0151758 A1 * 6/2009 Kristensson ..... A47L 15/4257 134/201
2012/0139402 A1 * 6/2012 Haidar ..... F25D 25/025 312/404
2013/0093306 A1 * 4/2013 Shin ..... F25D 23/021 312/404

* cited by examiner

BASKET DRAWER STRUCTURE

BACKGROUND OF THE INVENTION

Field of the Invention

The present invention relates to a cabinet for accommodating objects (such as clothes) and, more particularly, to a basket drawer which pulls rollers easily.

Description of the Prior Art

A conventional cabinet is applied to accommodate objects and contains a drawer fixed across a rail, so the drawer is pulled difficultly because of pulling resistance. To decrease the pulling resistance, the conventional cabinet contains a drawer, two rails, and two rollers arranged on the two rails respectively, such that the drawer is pulled easily. However, the two rollers are arranged on the two rails respectively, thus occupying storage space and increasing manufacture cost.

A conventional basket drawer contains a hollow accommodation space, and two rollers are arranged on two rails of the cabinet, thus having an unattractive appearance. Furthermore, it is not easy to form the two rails on cables of the basket drawer, so the two rollers are arranged on the two rails of the conventional cabinet. The basket drawer when loaded cannot be pulled easily.

The present invention has arisen to mitigate and/or obviate the afore-described disadvantages.

SUMMARY OF THE INVENTION

The primary objective of the present invention is to provide a basket drawer structure in which a peripheral rib has two recessed portions respectively formed on two rear ends of two outer sides of the basket. Two orifices are defined inside the two recessed portions individually, and two first rollers are rotatably riveted on the two recessed portions respectively. Hence, the two first rollers of the basket correspond to two rail elements respectively, and two second rollers of the two rail elements correspond to the basket, so that the basket is supported and rolls by way of the two first rollers and the two second rollers, thus pulling the basket smoothly.

To obtain the above-mentioned objective, a basket drawer structure provided by the present invention contains: a basket and two rail elements.

The basket includes a mesh formed on a lower end of the basket, a holding space defined in the basket, an opening formed on an upper end of the basket, and a peripheral rib arranged around the opening and to have a square cross section of the peripheral rib. An inner wall of the peripheral rib connects with the mesh. The peripheral rib has two recessed portions respectively formed on two rear ends of two outer sides of the basket. The two recessed portions define two depths, two orifices are defined inside the two recessed portions individually, and two first rollers are rotatably riveted on the two recessed portions respectively. The two recessed portions have two shaft holes defined thereon individually, and two rivets insert through the two shaft holes to rivet with two centers of the two first rollers individually. Hence, the two first rollers are rotatably riveted on the two recessed portions respectively, and the two orifices of the two recessed portions provide two riveting spaces to the two first rollers individually.

The two rail elements are spaced and symmetrically fixed on a shelf or a cabinet. A distance between the two rail elements is equal to a width of the basket. The two rail elements respectively include two support rails arranged on two inner sides of the two rail elements. Two second rollers are riveted on two front ends of the two support rails individually. The basket is retained in the two support rails by way of the peripheral rib, and the two second rollers of the two rail elements are mounted in the peripheral rib.

DETAILED DESCRIPTION OF THE PREFERRED EMBODIMENTS

Figure 1:
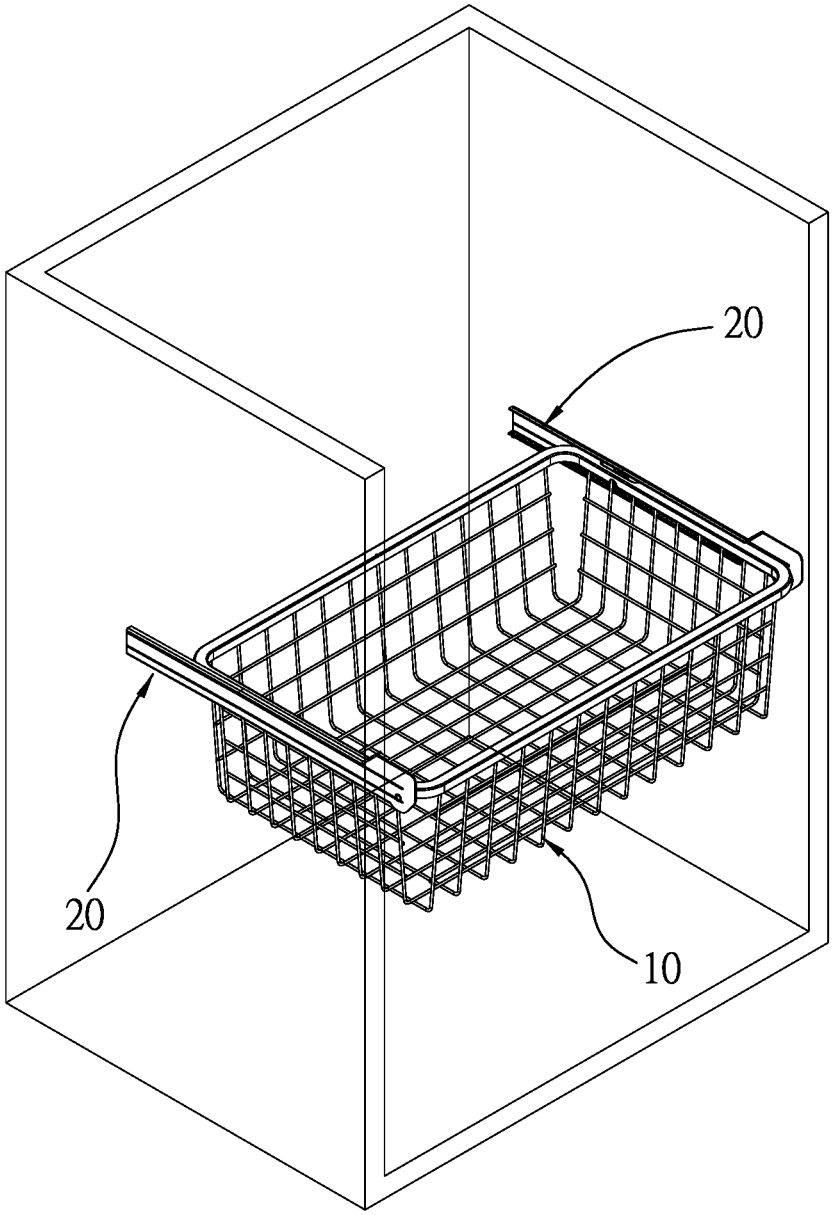
FIG. 1 is a perspective view showing the assembly of a basket drawer structure according to a preferred embodiment of the present invention.
Figure 2:
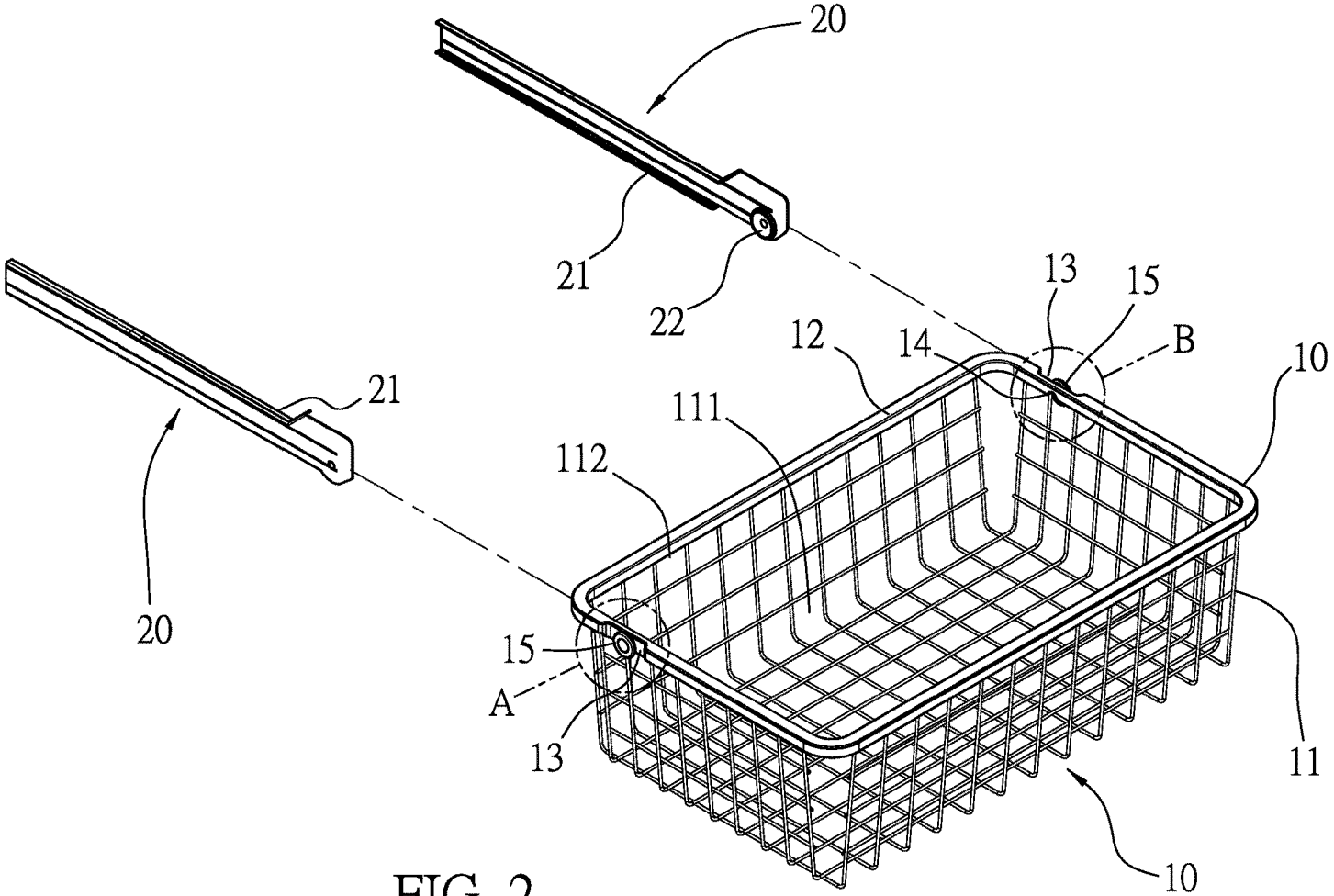
FIG. 2 is a perspective view showing the exploded components of the basket drawer structure according to the preferred embodiment of the present invention.

The present invention will be clearer from the following description when viewed together with the accompanying drawings, which show, for purpose of illustration only, preferred embodiments in accordance with the present invention.

With reference to FIGS. 1 to 4, a basket drawer structure according to a preferred embodiment of the present invention comprises: a basket 10 and two rail elements 20.

The basket 10 includes a mesh 11 formed on a lower end thereof, a holding space 111 defined in the basket 10, an opening 112 formed on an upper end of the basket 10, and a peripheral rib 12 arranged around the opening 112 to have a square cross section of the peripheral rib 12. An inner wall of the peripheral rib 12 connects with the mesh 11. The peripheral rib 12 has two recessed portions 13 respectively formed on two rear ends of two outer sides of the basket 10. The two recessed portions 13 define two depths H0, two orifices 14 are defined inside the two recessed portions 13 individually, and two first rollers 15 are rotatably riveted on the two recessed portions 13 respectively. The two orifices 14 of the two recessed portions 13 provide two riveting spaces to the two first rollers 15 individually.

The two rail elements 20 are spaced and symmetrically fixed on a shelf or a cabinet. A distance between the two rail elements 20 is equal to a width of the basket 10. The two rail elements 20 respectively include two support rails 21 arranged on two inner sides of the two rail elements 20. Two second rollers 22 are riveted on two front ends of the two support rails 21 individually. The basket 10 is retained in the two support rails 21 by way of the peripheral rib 12, and the two second rollers 22 of the two rail elements 20 are mounted in the peripheral rib 12, so that two rail elements 20 support the basket 10. The two first rollers 15 of the basket 10 are accommodated in the two support rails 21, so that the two rail elements 20 support the basket 10.

When the basket 10 is fixed between the two rail elements 20, two front ends of the two rail elements 20 support the basket 10 by using the two second rollers 22, and a rear end of the basket 10 supports the two rail elements 20 by way of the two first rollers 15.

Figure 3:
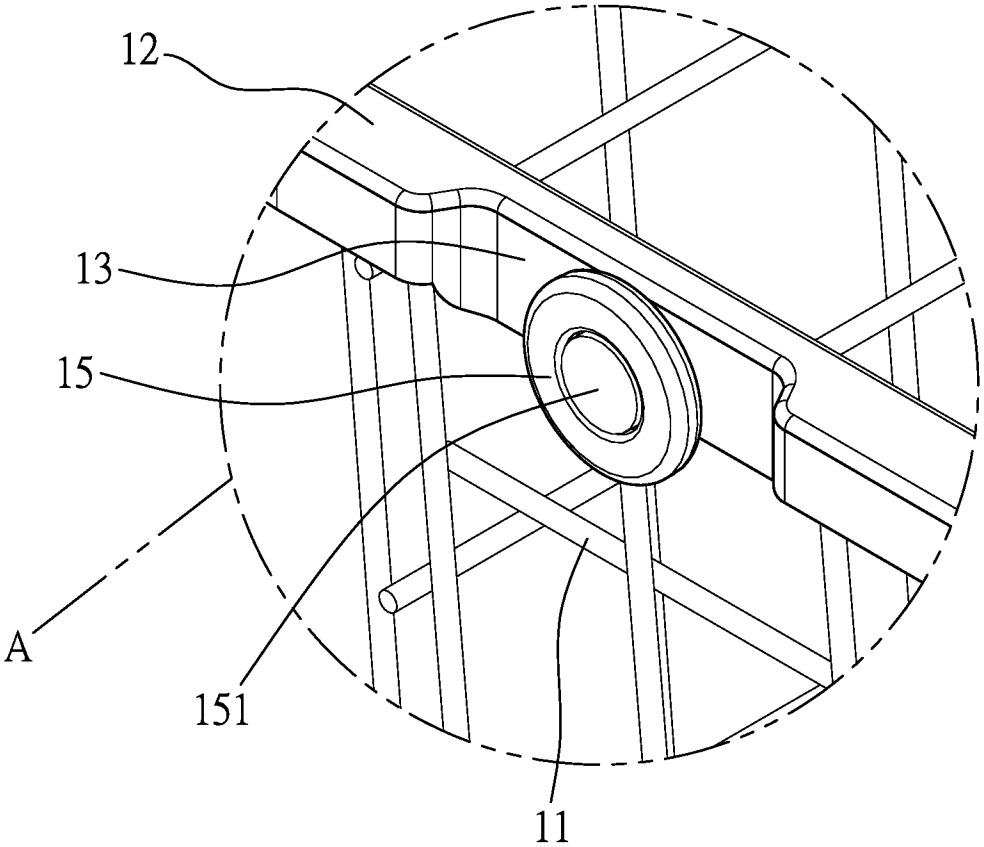
FIG. 3 is an amplified view of a portion A of FIG. 2.
Figure 4:
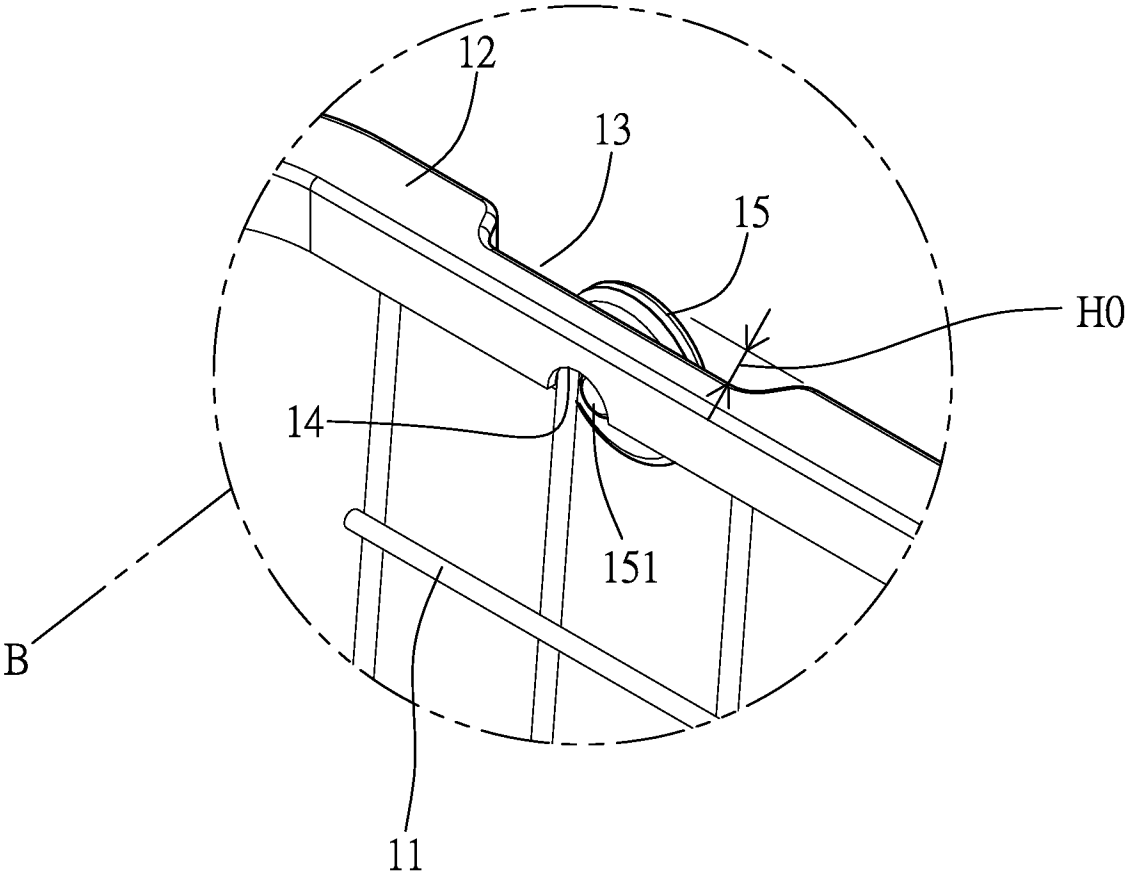
FIG. 4 is an amplified view of a portion B of FIG. 2.
Figure 5:
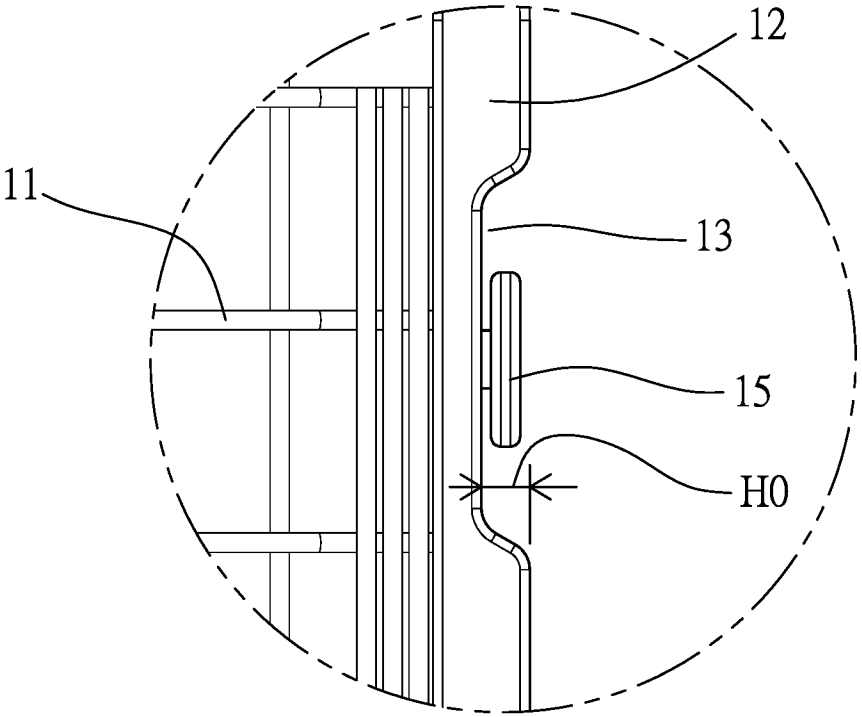
FIG. 5 is a top elevational view of FIG. 3.

Referring to FIGS. 3-5, the peripheral rib 12 of the basket 10 reinforces the basket 10, and the two recessed portions 13 facilitate accommodation of the two first rollers 15, so that the two first rollers 15 do not extend or do not overly extend out of the two recessed portions 13, thus saving space and reinforcing the basket 10.

Figure 6:
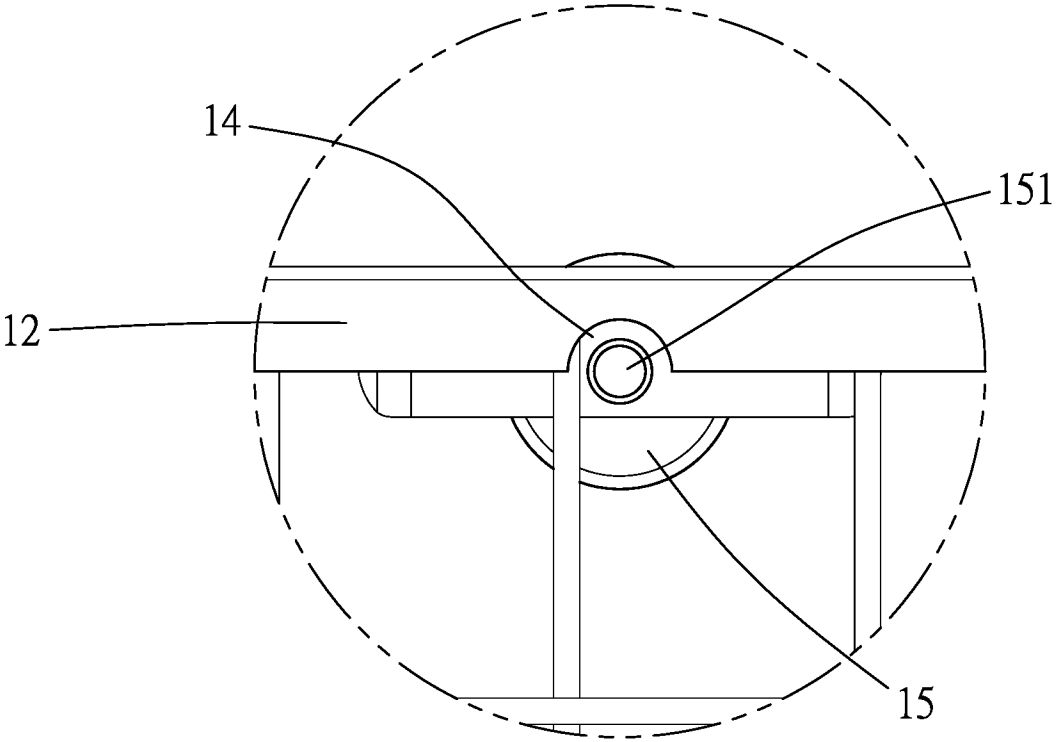
FIG. 6 is a side plan view of FIG. 4.
Figure 7:
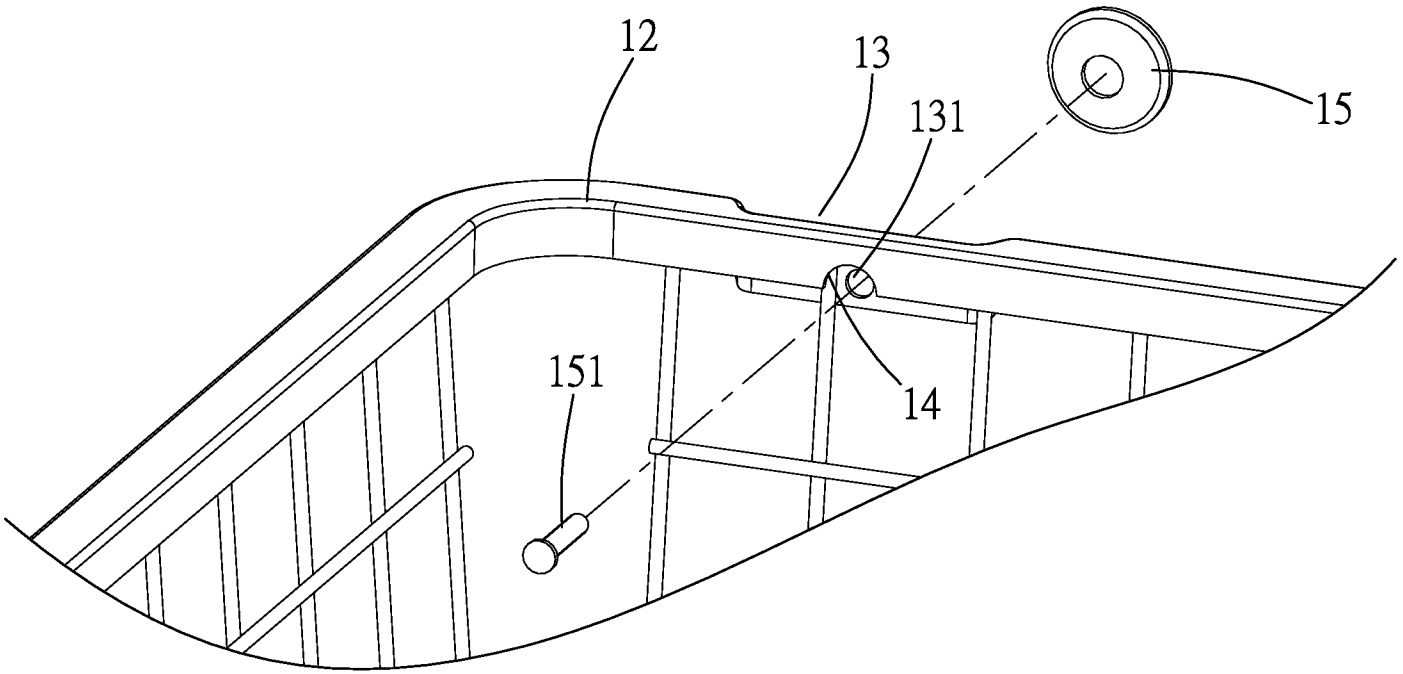
FIG. 7 is a perspective view showing the assembly of a part of the basket drawer structure according to the preferred embodiment of the present invention.

As shown in FIGS. 4, 6 and 7, the two recessed portions 13 of the peripheral rib 12 of the basket 10 have two shaft holes 131 defined thereon individually. Two rivets 151 insert through the two shaft holes 131 to rivet with two centers of the two first rollers 15 individually. Two first rollers 15 are rotatably riveted on the two recessed portions 13 respectively, and the two first rollers 15 do not extend over the two depths H0 of the two recessed portions 13 individually Accordingly, the two first rollers 15 of the basket 10 correspond to the two rail elements 20 respectively, and the two second rollers 22 of the two rail elements 20 correspond to the basket 10, so that the basket 10 is supported and rolls by way of the two first rollers 15 and the two second rollers 22, thus pulling the basket 10 smoothly and saving effort.

While various embodiments in accordance with the present invention have been shown and described, it is clear to those skilled in the art that further embodiments may be made without departing from the scope of the present invention.

What is claimed is:

1. A basket drawer structure comprising: a basket and two rail elements;

with the basket including a mesh formed on a lower end of the basket, a holding space defined in the basket, an opening formed on an upper end of the basket, and a peripheral rib arranged around the opening, with the peripheral rib having square cross sections, with an inner wall of the peripheral rib connecting with the mesh; with the peripheral rib having two recessed portions formed on rear ends of outer sides of the basket, with the two recessed portions having depths, with orifices defined inside the two recessed portions, with two first rollers rotatably riveted on the two recessed portions respectively, wherein the two recessed portions have shaft holes, wherein two rivets insert through the shaft holes to rivet with centers of the two first rollers, wherein the two first rollers are rotatably riveted on the two recessed portions respectively, wherein the two first rollers do not extend over the depths of the two recessed portions;

with the two rail elements adapted to be spaced and symmetrically fixed on a cabinet, with a distance between the two rail elements being equal to a width of the basket, wherein the two rail elements respectively include two support rails arranged on inner sides of the two rail elements, with two second rollers riveted on front ends of the two support rails, wherein the basket is retained in the two support rails by way of the peripheral rib, and wherein the two second rollers of the two rail elements are mounted in the peripheral rib.

2. A basket drawer structure comprising:

a basket including a mesh formed on a lower end of the basket, a holding space defined in the basket, an opening formed on an upper end of the basket, and a peripheral rib arranged around the opening, with the peripheral rib having square cross sections, with an inner wall of the peripheral rib connecting with the mesh; with the peripheral rib having two recessed portions respectively formed on rear ends of outer sides of the basket, with the two recessed portions having depths, with orifices defined inside the two recessed portions, with two first rollers rotatably riveted on the two recessed portions respectively, wherein the two recessed portions have openings, wherein two rivets insert through the openings to rivet with centers of the two first rollers, and wherein the two first rollers do not extend over the depths of the two recessed portions.

* * * * *